US005856812A

United States Patent [19]

Hush et al.

[11] Patent Number: 5,856,812

[45] Date of Patent: Jan. 5, 1999

[54] CONTROLLING PIXEL BRIGHTNESS IN A FIELD EMISSION DISPLAY USING CIRCUITS FOR SAMPLING AND DISCHARGING

[75] Inventors: Glen E. Hush; Tyler A. Lowrey, both of Boise, Id.

[73] Assignee: Micron Display Technology, Inc., Boise, Id.

[21] Appl. No.: 637,353

[22] Filed: Apr. 24, 1996

Related U.S. Application Data

[63] Continuation-in-part of Ser. No. 305,107, Sep. 13, 1994, abandoned, which is a continuation of Ser. No. 102,598, Aug. 5, 1993, abandoned, which is a continuation-in-part of Ser. No. 60,111, May 11, 1993, abandoned.

[51] Int. Cl.[6] ..... G09G 3/22

[52] U.S. Cl. ..... 345/74; 345/77

[58] Field of Search ..... 345/63, 60, 77, 345/76, 55, 87, 88, 89, 105, 211, 212, 74, 75, 47; 315/169.1, 169.3, 169.4

[56] References Cited

U.S. PATENT DOCUMENTS

| | | | |
|---|---|---|---|
| 3,761,617 | 9/1973 | Tsuchiga et al. | 345/77 |
| 3,883,778 | 5/1975 | Kaji et al. | 345/63 |
| 4,020,280 | 4/1977 | Kaneko et al. | 345/63 |
| 4,514,727 | 4/1985 | Van Antwerp | 345/148 |
| 4,554,539 | 11/1985 | Graves | 345/211 |
| 4,743,096 | 5/1988 | Wakai et al. | 350/333 |
| 4,908,539 | 3/1990 | Meyer | 315/169.3 |
| 5,012,153 | 4/1991 | Atkinson et al. | 315/169.1 |
| 5,036,317 | 7/1991 | Buzak | 345/74 |
| 5,103,144 | 4/1992 | Dunham | 315/366 |
| 5,103,145 | 4/1992 | Doran | 315/381 |
| 5,153,483 | 10/1992 | Kishino et al. | 315/3 |
| 5,157,309 | 10/1992 | Parker et al. | 315/169.1 |
| 5,196,839 | 3/1993 | Johary et al. | 340/793 |
| 5,210,472 | 5/1993 | Casper et al. | 315/349 |
| 5,262,698 | 11/1993 | Dunham | 345/30 |
| 5,283,500 | 2/1994 | Kochanski | 315/58 |
| 5,313,140 | 5/1994 | Smith et al. | 315/169.1 |
| 5,357,172 | 10/1994 | Lee et al. | 315/167 |
| 5,387,844 | 2/1995 | Browning | 315/169.3 |
| 5,402,041 | 3/1995 | Kishino et al. | 315/169.1 |
| 5,410,218 | 4/1995 | Hush | 315/169.1 |
| 5,631,664 | 5/1997 | Adachi et al. | 345/74 |
| 5,642,017 | 6/1997 | Hush | 345/74 |

FOREIGN PATENT DOCUMENTS

| | | | |
|---|---|---|---|
| 0371798 | 6/1990 | European Pat. Off. | 345/77 |
| 0381479 | 8/1990 | European Pat. Off. | 345/77 |

OTHER PUBLICATIONS

"The NTSC Color Television Standards," *Proceedings of the I–R–E,* pp. 46–48, Jan. 1954.

"NTSC Signal Specifications," *Proceedings of the I–R–E,* pp. 17–19, Jan. 1954.

Bruch, Walter "The Pal Colour TV Transmission System," *IEEE Trans.–BTR* (vol. BTR–12): pp. 87–100, 1966.

Loughlin, Bernard D. "The Pal Color Television System," *IEEE Trans.–BTR* (vol. BTR–12): pp. 153–158, 1966.

*Primary Examiner*—Chanh Nguyen

*Attorney, Agent, or Firm*—Seed and Berry LLP

[57] ABSTRACT

A flat panel display, such as a Field Emission Display ("FED"), is disclosed having a current control circuit. Input into the display, initially, is an analog signal having an amplitude. In one embodiment, the current control circuit includes a converter for converting the analog input signal to a sawtooth signal having a height and width. Then, the level of the sawtooth signal is compared to a voltage level to establish a pulse width of an emitter current. The emitter current is thus controlled by a pulse width modulation approach. In another embodiment, the current control circuit traps a column voltage on a parasitic capacitance. The trapped voltage then controls the gate of a transistor to control current flow from the emitter set to ground.

3 Claims, 9 Drawing Sheets

CONTROLLING PIXEL BRIGHTNESS IN A FIELD EMISSION DISPLAY USING CIRCUITS FOR SAMPLING AND DISCHARGING

CROSS-REFERENCE TO RELATED APPLICATION

This is a Continuation-in-Part of U.S. patent application Ser. No. 08/305,107 filed Sep. 13, 1994, now abandoned, which is a File Wrapper Continuation of U.S. patent application Ser. No. 08/102,598 filed Aug. 5, 1993, now abandoned, which is a Continuation-in-Part of U.S. patent application Ser. No. 08/060,111 filed May 11, 1993, now abandoned.

STATEMENT OF GOVERNMENT INTEREST

This invention was made with government support under Contract No. DABT-63-93-C-0025 awarded by Advanced Research Projects Agency (ARPA). The government has certain rights in this invention.

TECHNICAL FIELD

The present invention pertains to field emission display ("FED") devices. More particularly, the invention relates to a system for controlling brightness of a FED.

BACKGROUND OF THE INVENTION

Until recently, the cathode ray tube ("CRT") has been the primary device for displaying information. While having sufficient display characteristics with respect to color, brightness, contrast and resolution, CRTs are relatively bulky and power hungry. These failings, in view of the advent of portable laptop computers, has intensified demand for a display technology which is lightweight, compact, and power efficient.

One available technology is the flat panel display, and more particularly, the liquid crystal display ("LCD"). LCDs are currently used for laptop computers. However, LCDs provide poor contrast in comparison to CRT technology. Further, LCDs offer only a limited angular display range. Moreover, color LCD devices consume power at rates incompatible with extended battery operation. In addition, a color LCD type screen tends to be far more costly than an equivalent CRT.

In light of these shortcomings, there have been several developments recently in thin film, field emission display ("FED") technology. In U.S. Pat. No. 5,210,472, commonly assigned with the present invention, and incorporated herein by reference, a FED design is disclosed which utilizes a matrix-addressable array of pointed, thin-film, cold cathode emitters in combination with a conductive, transparent screen having a conductive coating which is in turn, coated with a cathodoluminescent material. An extraction grid having a plurality of openings aligned with respective emitters is positioned between the emitters and the screen. The screen is biased at a relatively high voltage on the order of 80 V to 1 KV. When the voltage of the extraction grid is sufficiently higher than the voltage of the emitters, electrons are emitted from the underlying emitter and are attracted to the conductive screen. When the electrons strike the cathodoluminescent material, light is emitted at the point of impact. The intensity of the emitted light is proportional to the rate at which electrons are emitted which is, in turn, proportional to the voltage differential between the extraction grid and emitter. The FED incorporates a column signal to activate a single column extraction grid, while a row signal activates a row of emitters. At the intersection of both an activated column and an activated row, a grid-to-emitter voltage differential exists sufficient to induce electron emission. Extensive research has recently made the manufacture of an inexpensive, low power, high resolution, high contrast, full color FED a more feasible alternative to LCDs.

In order to achieve the advantages of this technology, as in the performance of LCDs, FED devices require a brightness control scheme. Several techniques have been proposed to control the brightness and gray scale range. For example, U.S. Pat. No. 5,103,144 to Dunham and U.S. Pat. No. 5,103,145 to Doran, both incorporated herein by reference, teach methods for controlling the brightness and luminance of flat panel displays. However, a need remains for a brightness control scheme that requires less power and is simpler to manufacture. Further, a need exists for a brightness control scheme requiring less circuitry and thus less surface area on a silicon die.

SUMMARY OF THE INVENTION

Accordingly, a flat panel display of the present invention, includes an emitter current control circuit that controls an emitter set in a FED. The current control circuit converts an analog input to a control signal to control the rate at which electrons are emitted by the emitter set, where the rate of electron emission corresponds to the analog input signal's amplitude.

In one embodiment of the present invention, a gray scale generator adjusts the gray scale range of the FED to provide contrast to the FED.

In another embodiment of the invention, an optical sensor senses ambient light surrounding the flat panel display and produces an electrical signal in response thereto. The control circuit receives the electrical signal and modifies the control signal in response.

In another embodiment of the invention, the current control circuit includes a parasitic capacitance coupled to a control line, such as a column line, by a pass transistor. The pass transistor selectively couples a control voltage from the control line to the parasitic capacitance to charge the parasitic capacitance. The pass transistor then turns OFF to isolate the parasitic capacitance and trap the control voltage on the parasitic capacitance. The trapped control voltage drives the gate of an NMOS transistor coupled between the emitter set and ground. In response to the control voltage, the NMOS transistor passes current so that the emitter set emits electrons, thereby illuminating a pixel of the display.

Other advantages will become apparent to those skilled in the art from the following detailed description read in conjunction with the appended claims and the drawings attached hereto.

BRIEF DESCRIPTION OF THE DRAWINGS

The present invention will be better understood from reading the following description of non-limitative embodiments, with reference to the attached drawings.

DETAILED DESCRIPTION OF THE INVENTION

Figure 1:
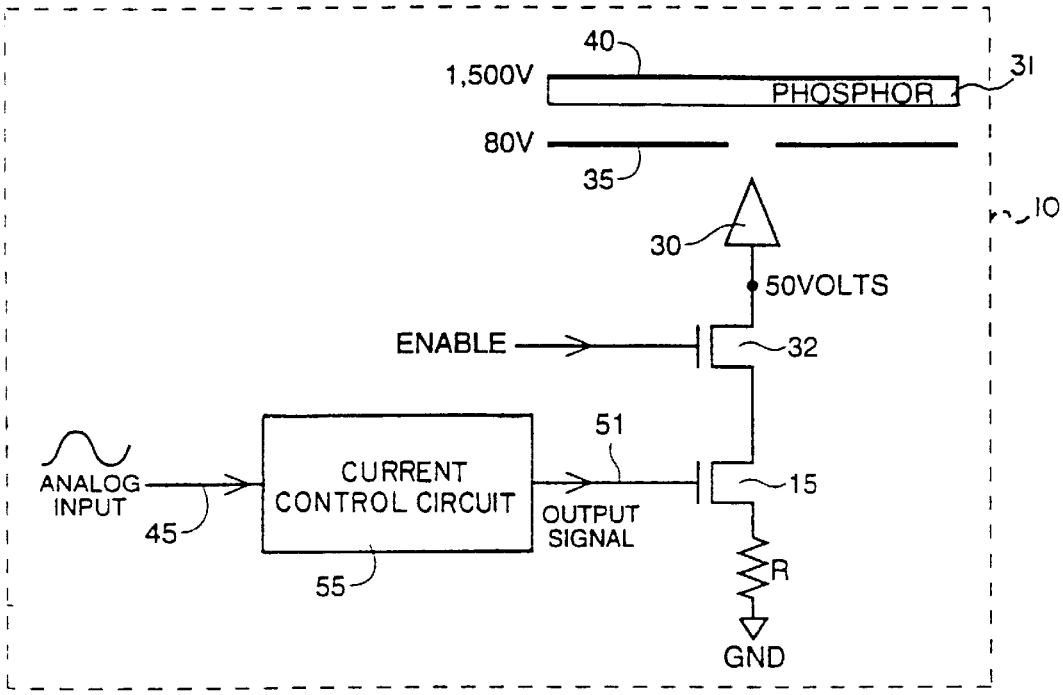
FIG. 1 is a schematic diagram of a field emission display device of the present invention.

In FIG. 1, a FED 10 of the present invention includes an emitter set 30 which is connected to ground through a resistor R, an NMOS transistor 15, and an NMOS enable/disable transistor 32. For clarity of presentation, the emitter set 30 is represented as a single emitter tip. However, one skilled in the art will recognize that such emitter sets 30 typically include many emitter tips. The emitter set 30, resistor R and NMOS transistors 15, 32 are preferably integrated into or onto a semiconductor substrate. As used herein, semiconductor substrate can refer to a conventional semiconductor substrate, a transparent substrate carrying thin film transistors (TFTs) or any other substrate into or onto which integrated circuit devices can be fabricated.

The emitter set 30 is positioned in a vacuum near an extraction grid 35 and a transparent conductive anode 40. The anode 40 is coated with a cathodoluminescent layer 31. Both the extraction grid 35 and the anode 40 are electrically biased, with the extraction grid 35 having a substantially lower voltage than the anode 40. In one embodiment, the extraction grid 35 is biased to a voltage of 80 volts, while the anode 40 is biased to about 1500 volts. However, one skilled in the art will recognize that these voltages can be varied, so long as the voltage of the extraction grid 35 is substantially lower than the voltage of the anode 40.

As is known, if the emitter set 30 is grounded or otherwise coupled to a low voltage, the voltage differential between the extraction grid 35 and the emitter set 30 produces a strong electric field between the extraction grid 35 and the emitter set 30. The electric field causes the emitter set 30 to emit electrons.

The voltage differential between the extraction grid 35 and the anode 40 causes the electrons emitted from emitter set 30 to travel toward the anode 40. As the electrons travel toward the anode 40, they strike the cathodoluminescent layer 31. The area of the cathodoluminescent layer 31 bombarded by the electrons emits light. Because the effect of multiple electrons is cumulative, the intensity of the emitted light is proportional to the rate at which electrons strike the cathodoluminescent layer 31 which is, in turn, proportional to the voltage between the emitter set 30 and the extraction grid 35.

The FED 10 employs a pulse width modulation approach to control the rate at which electrons are emitted by controlling current to the emitter set 30 with the transistor 15. In order to achieve a range of illumination, a current control circuit 55 controls the gate voltage of the transistor 15 with a series of output pulses 51 in response to an analog input signal 45. The current control circuit 55 varies the pulse width to control the gray scale range and brightness of the FED 10. Gray scale range is definable as a range from the minimum to the maximum illumination intensity of a pixel of the FED 10.

Figure 2A:
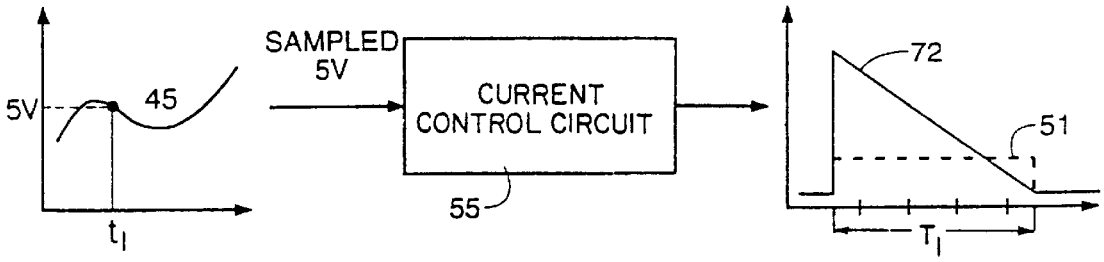
FIGS. 2A and B illustrate transfer functions of a current control circuit according to the present invention.
Figure 2B:
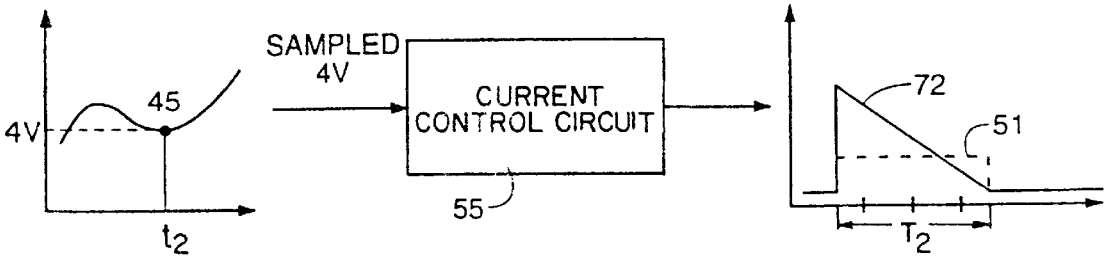

FIGS. 2A and B illustrate the input signal 45 and output pulse 51 of the current control circuit 55. The current control circuit 55 samples the analog input signal 45 at a predetermined frequency. The current control circuit 55 then converts the value of the sampled analog signal input 45 into the output pulse 51, which is a fixed amplitude pulse having a width corresponding to the sampled voltage. For example, in FIG. 2A, the input signal 45 is sampled at a time $t_1$, to produce first sampled voltage of 5 volts. In response, the current control circuit 55 produces the output pulse 51 with a duration $T_1$. In FIG. 2B the input signal 45 is sampled a time $t_2$ to produce a second sampled voltage of 4 volts. In response, the current control circuit 55 produces the output pulse 51 with a duration $T_2$, shorter than the duration $T_1$. The pulse width thus corresponds to the amplitude of the input signal 45 when the sample is taken. The range from the minimum to the maximum pulse width corresponds to the range from minimum to maximum intensity level of the emitted light.

As will be explained below, the current control circuit 55 produces the output pulses 51 from a sawtooth signal 72 as represented in FIGS. 2A and B where the slope of the sawtooth signal 72 preferably remains constant. As will also be explained below, the pulse width is varied by varying the height of the initial peak in the sawtooth pulse. The pulses 51, 72 can either begin at the same time and end at different times, subject to the requisite signal width, or start at different times and end at the same time, subject to the requisite signal width.

Figure 3:
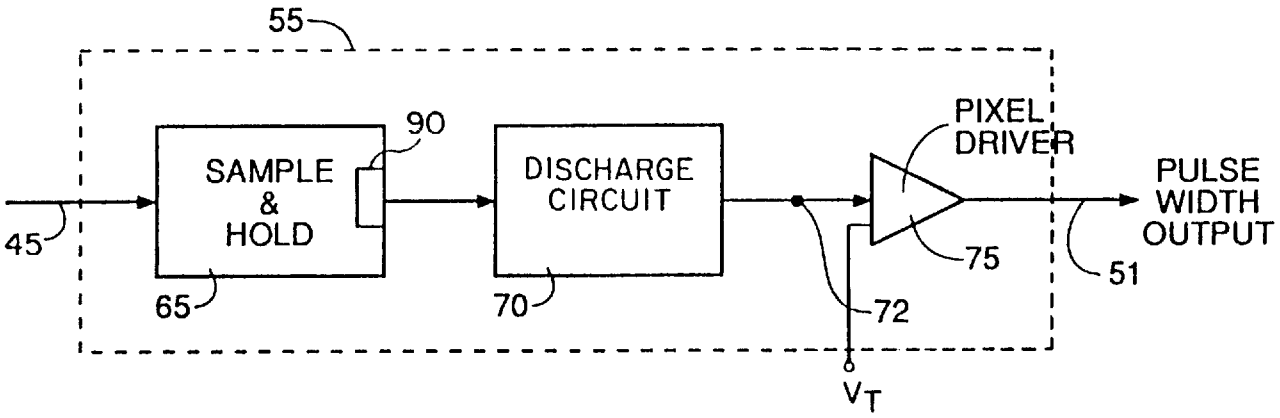
FIG. 3 is a block diagram of FIGS. 2A and B coupled to a pixel driver for producing a pulsed signal.

As shown in FIG. 3, the current control circuit 55 includes a sample and hold circuit 65 serially coupled to a discharge circuit 70. Upon receiving the analog input signal 45 comprising a red, green and/or blue signal, in PAL signal or NTSC signal configuration, the sample and hold circuit 65 initially samples the signal at a predetermined frequency and then stores the sample in a holding circuit 90, until the next sample is taken. In the preferred embodiment, the holding circuit 90 is a capacitor.

A discharge circuit 70 is coupled to the output of sample and hold circuit 65 to controllably discharge the holding circuit 90. For the purposes of illustration, the discharge circuit 70 is coupled directly to the sample and hold circuit 65. However, other circuit configurations may be within the scope of the invention.

The discharge circuit 70 preferably is a variably compliant current source. Nonetheless, one skilled in the art may devise feasible alternatives, such as a current mirror. The discharging circuit 70 provides a predetermined current irrespective of the sampled voltage.

Figure 4A:
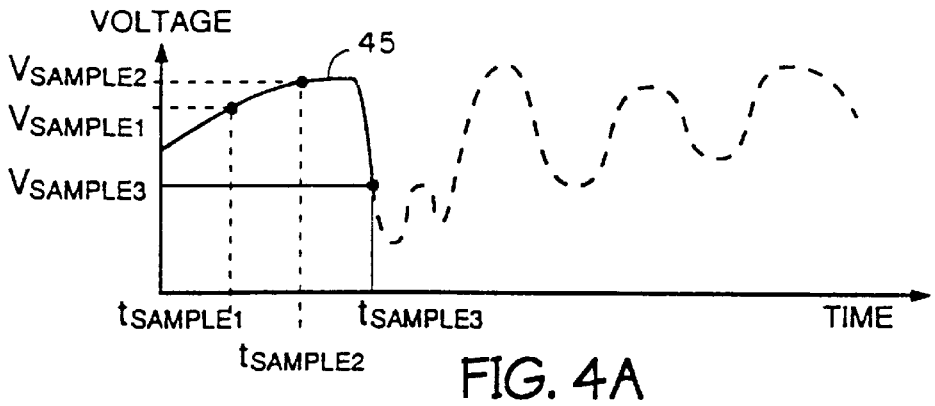
FIGS. 4A–D are waveform diagrams illustrating signals at respective stages of signal development according to the present invention.
Figure 4B:
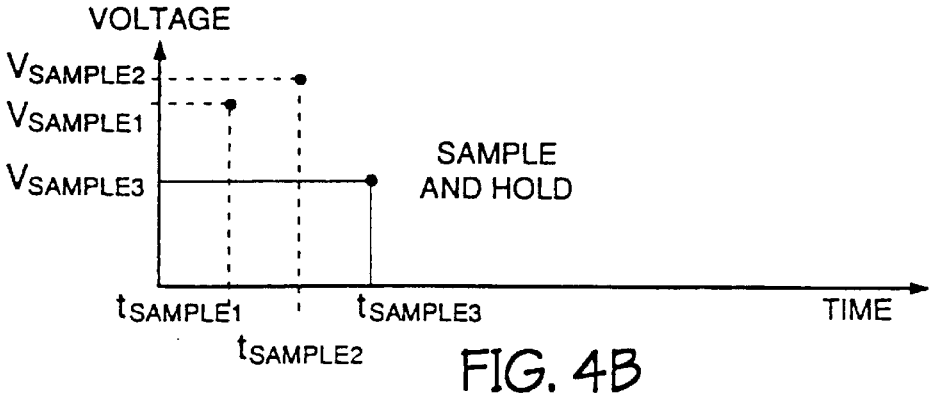

FIGS. 4A–D show the signals at selected stages of the current control circuit 55. With respect to FIG. 4A, the analog input signal 45 is input to the current control circuit 55. The sample and hold circuit 65 samples the input signal 45 at the predetermined frequency. For example, at times $t_{sample1}$, $t_{sample2}$ and $t_{sample3}$, the sample and hold circuit 65 samples voltages $V_{sample1}$, $V_{sample2}$ and $V_{sample3}$. As shown in FIG. 4B the voltages $V_{sample1}$, $V_{sample2}$ and $V_{sample3}$ are stored in the holding circuit 90 (FIG. 3).

Figure 4C:
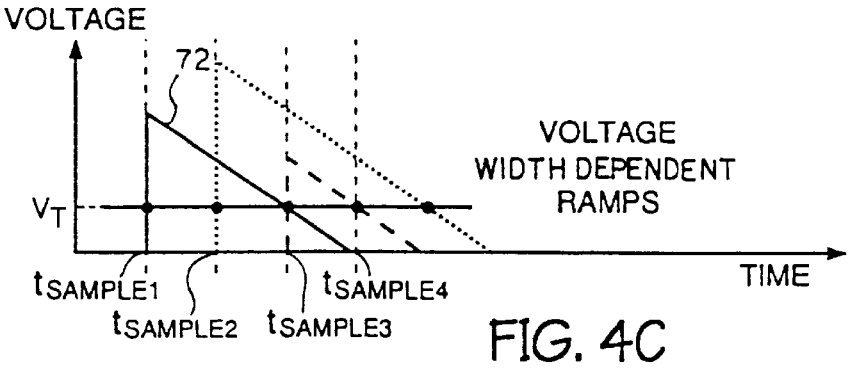

The holding circuit 90 is a capacitor discharged with a fixed current by the discharge circuit 70 after each sample. The voltage of the holding circuit 90 is thus a series of sawtooth ramps forming the sawtooth signal 72. FIG. 4C depicts three sawtooth ramps where the initial peak of each sawtooth ramp corresponds respectively to a sampled voltage, $V_{sample1}$, $V_{sample2}$ and $V_{sample3}$.

In the embodiment of the present invention of FIG. 3, the current control circuit 55 includes a pixel driver 75 that receives the sawtooth output signal 72 of the discharge circuit 70. The pixel driver 75 generates the pulse width modulated output signal 51 by comparing the sawtooth output signal 72 with a predetermined threshold voltage $V_T$. If the magnitude of the sawtooth signal 72 is greater than the threshold voltage $V_T$, the pixel driver 75 outputs a high signal. When the magnitude of the sawtooth signal 72 falls below the threshold voltage $V_T$, the pixel driver 75 outputs a low signal. The pixel driver 75 thus produces the output pulse 51 with a width corresponding to the time during which the sawtooth signal 72 is greater than the threshold voltage $V_T$. Because the sawtooth signal 72 has a constant slope, the time during which the sawtooth signal 72 is greater than the threshold voltage $V_T$ depends upon the peak amplitude of the sawtooth signal. Thus, the pixel driver 75 converts the sawtooth signal 72 to the pulse width modulated output pulse 51, where the width of the pulse width modulated output signal 51 corresponds to the peak amplitude of the sawtooth signal 72, as shown in FIGS. 2A and B.

Figure 4D:
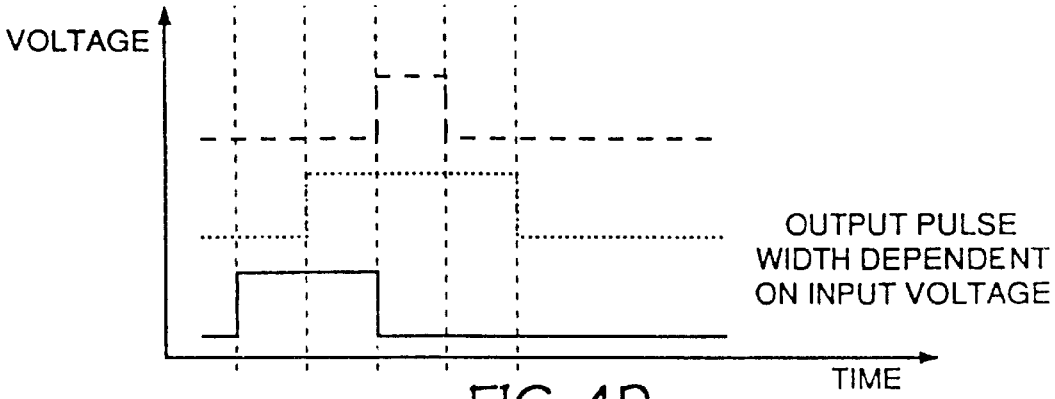

FIG. 4D illustrates three output pulses corresponding to the three signals of FIG. 4C, where each sawtooth ramp is converted into a respective output pulse 51 by the pixel driver 75. While the amplitude of the originally sampled analog signal 45 varies over time, the amplitude of each pulse width signal remains constant. However, the widths of the output pulses 51 directly correspond to the amplitude of the sampled analog signal input 45 at the respective sampling times $t_{sample1}$, $t_{sample2}$, and $t_{sample3}$.

Figure 5:
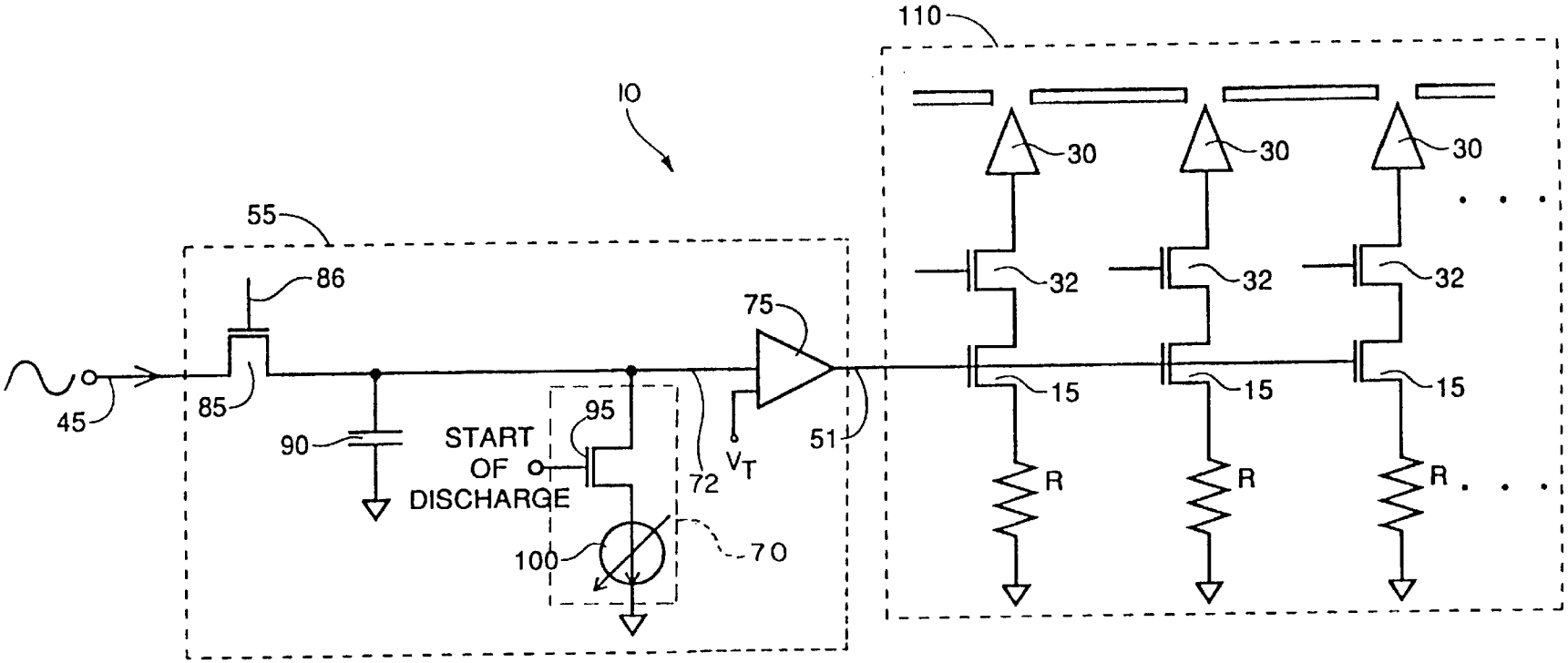
FIG. 5 is a schematic illustrating a preferred embodiment of the present invention.

FIG. 5 presents one realization of the current control circuit 55 shown driving a row 110 of the FED 10. Within the current control circuit 55, an NMOS sampling transistor 85 forms the sampling portion of the sample and hold circuit 65, where the channel of the sampling transistor 85 receives the analog input signal 45. One skilled in the art will recognize several realizations of the sampling portion, such as other types of switching devices. A sampling control signal 86 drives the gate of the control transistor 85 to selectively turn ON and OFF the sampling transistor 85 thereby transmitting samples of the input signal 45 to the holding circuit 90. The control signal 86 thus controls the sampling frequency.

The holding circuit 90 is coupled between the channel of the sampling transistor 85 and ground. The holding circuit 90 stores each of the sampled voltages transmitted by the sampling transistor 85, and at the appropriate time, discharges each stored sampled voltage through the discharge circuit 70.

The discharging circuit 70 is coupled in parallel with the holding circuit 90 to provide a current path to discharge each of the sampled voltages from the holding circuit 90. The discharging circuit 70 includes an NMOS discharge transistor 95 serially coupled to a current source 100. The discharge transistor 95 selectively enables and disables coupling of the constant current source 100 between the output of the holding circuit 90 and ground. In the preferred embodiment of the present invention, the constant current source 100 is a variably compliant current source.

A pulsed switching signal having the same periodicity as the control signal 86 controls the discharge transistor 95. Pulses of the switching signal are delayed with respect to pulses of the control signal 86 to allow the holding circuit 90 to charge to the sampled voltage before discharging begins. In the preferred embodiment, the time between the start of the control signal pulses and the switching signal pulses is minimal. Also, pulses of the switching signal typically are of longer duration than pulses of the control signal 86.

The holding circuit 90 charges quickly to its initial peak during the control signal pulses. Then, when the control signal returns low, the discharge transistor 95 allows the constant current source to discharge the holding circuit 90. As is known, a constant current outflow causes a capacitor voltage to decline linearly, forming the downwardly ramping portion of the sawtooth signal. While discharging circuit 70 is formed from the constant current source 100 serially connected to the channel of the discharge transistor 95, other feasible alternatives may be conceived by one of skill in the art.

The pixel driver 75 is coupled to detect the voltage of the holding circuit 90 and to drive the gate of the transistor 15. The pixel driver 75 compares the voltage of the holding circuit 90 to the threshold voltage $V_T$ and when the holding circuit voltage is greater than the threshold voltage $V_T$, turns ON the transistor 15 to let electrons flow to the emitter set 30. When the voltage of the holding circuit 90 falls below the threshold voltage $V_T$, the pixel driver 75 turns OFF the transistor 15, blocking electron flow to the emitter set 30. The pixel driver 75 thus provides a pulse width modulated driving voltage to the transistor 15, where the pulse width depends upon the height of the initial peak in the sawtooth signal 72.

Figure 8:
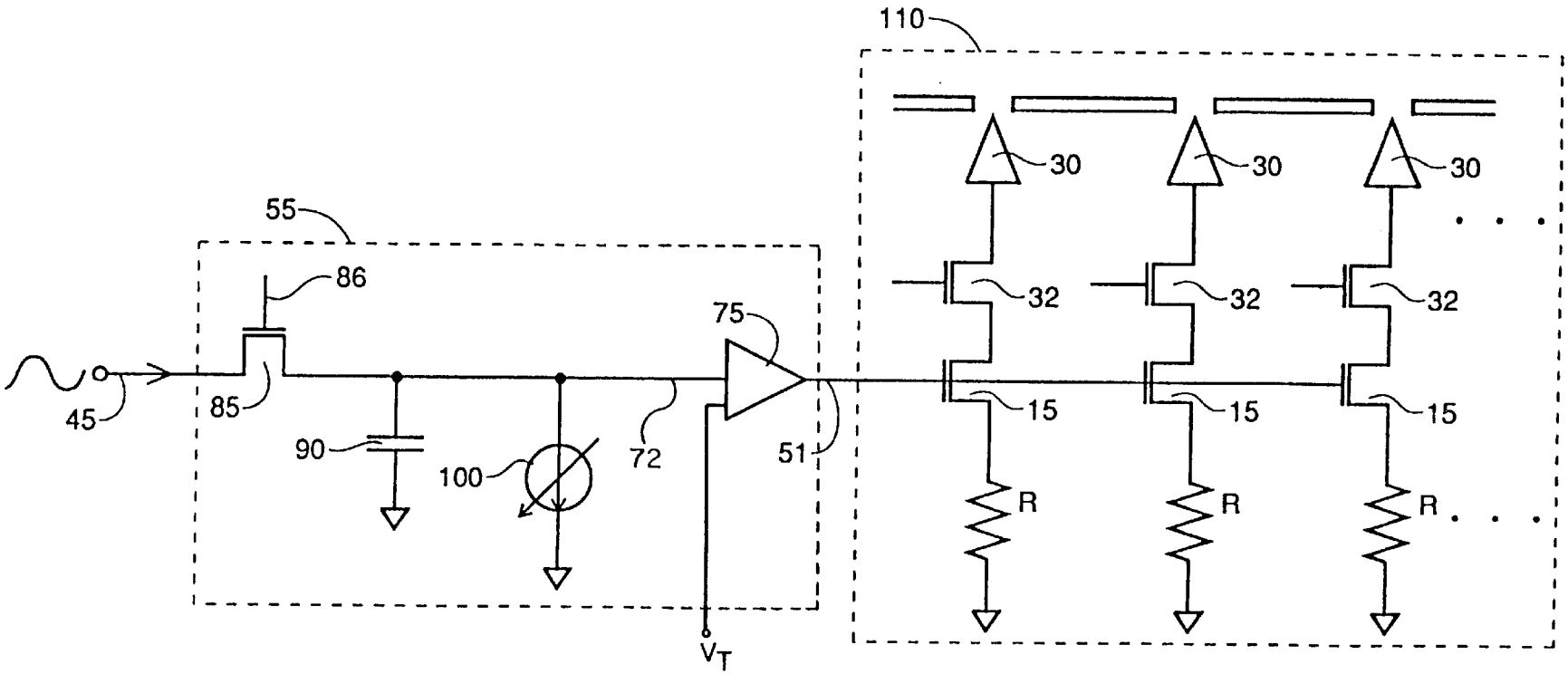
FIG. 8 is a schematic illustrating a fourth embodiment of the present invention with a buffered output.
Figure 9A:
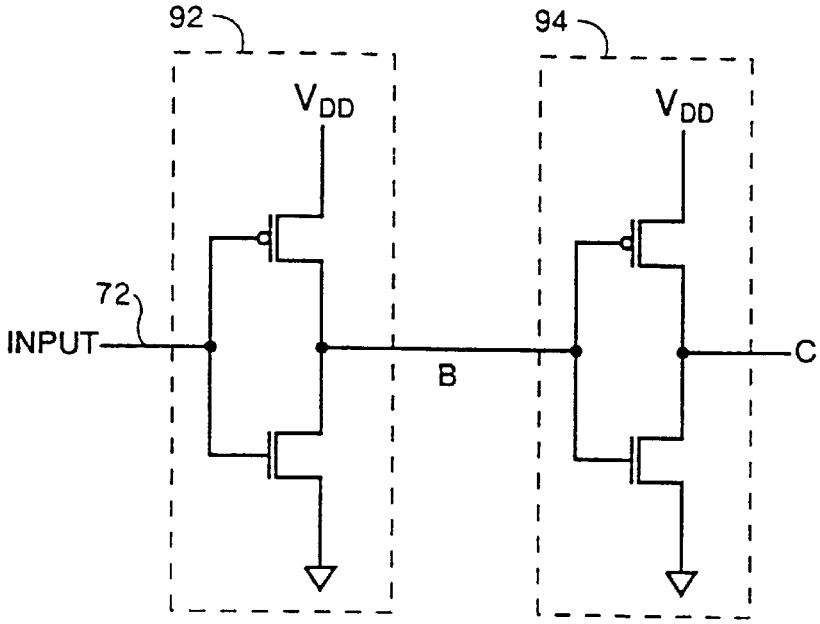
FIG. 9A is a schematic of the pixel driver in the embodiments of FIGS. 3, 5 and 8.
Figure 9B:
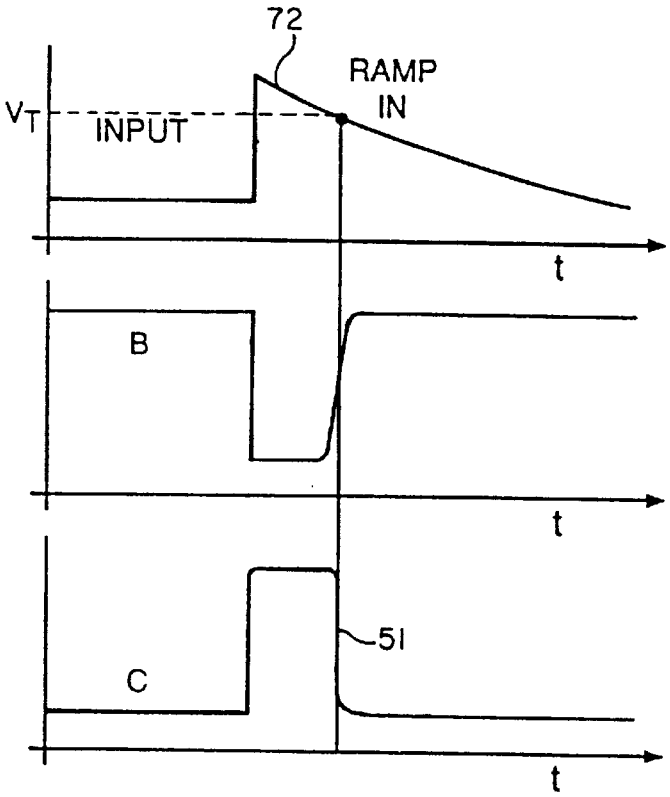
FIG. 9B is a waveform diagram showing input and output signals in the circuit of FIG. 9A.

FIG. 9A presents one realization of the pixel driver 75 including two serially connected complementary metal oxide semiconductor ("CMOS") inverters 92 and 94. The first inverter 92 receives the output sawtooth signal 72 (upper graph of FIG. 9B) from the discharge circuit 90 (FIGS. 3, 5, 8), and generates an inverted output with an associated time constant (center graph of FIG. 9B). The inverted output is high when the sawtooth signal 72 is less than the threshold voltage $V_T$ and low when the sawtooth signal 72 is greater than the threshold voltage $V_T$. The second inverter 94 receives and re-inverts the inverted signal to provide the output pulse 51 as shown in the lower graph of FIG. 9B.

Figure 6:
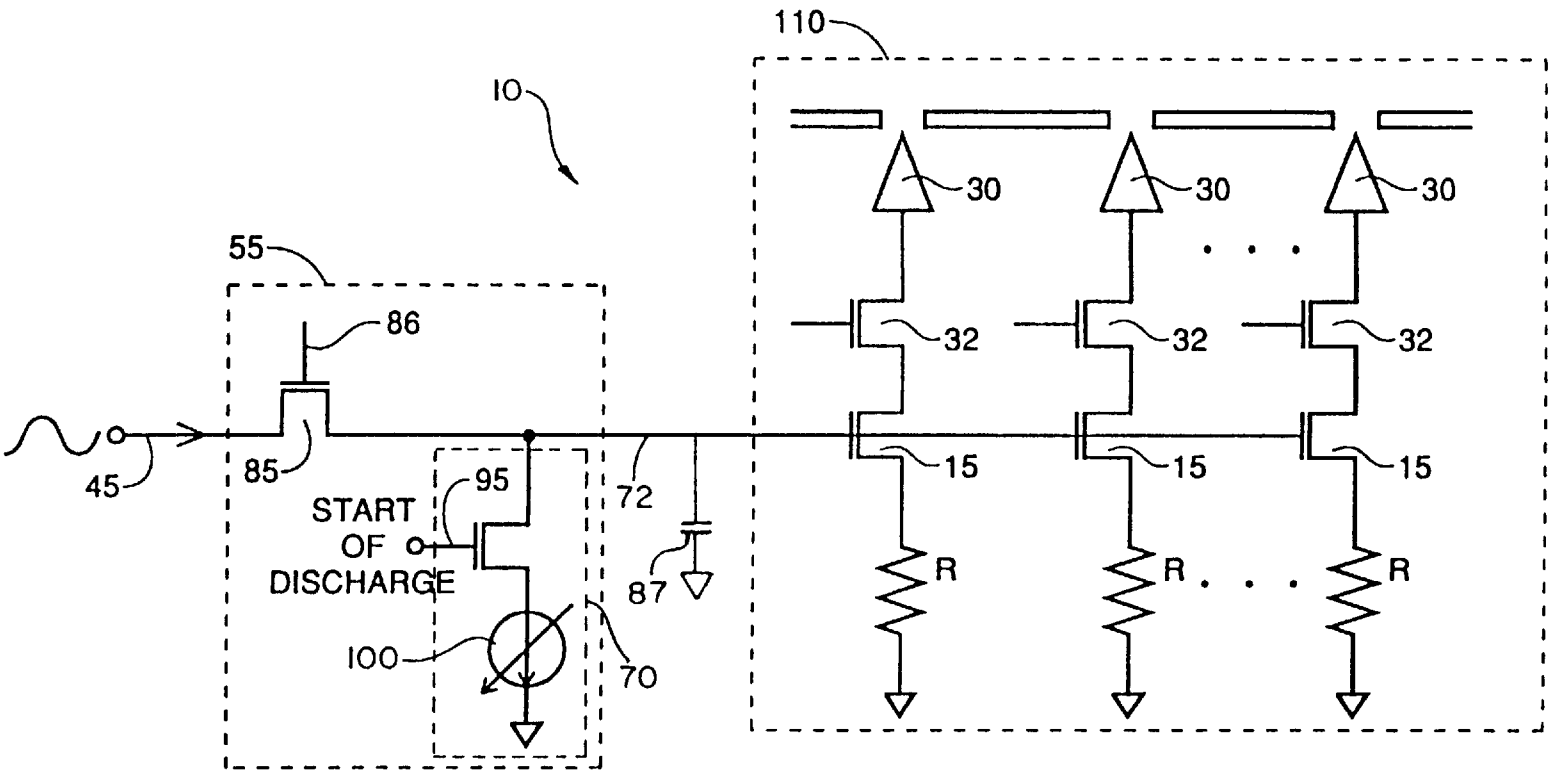
FIG. 6 is a schematic illustrating a second embodiment of the present invention with an FET-controlled current driving circuit and no capacitor.

FIG. 6 presents a second realization of the present invention in which the pixel driver 75 is eliminated and in which the holding circuit 90 is realized by a parasitic capacitance 87. Elements 45, 85, 86, 95, 100 and 110 are structurally and functionally equivalent to similarly numbered elements discussed with reference to FIG. 5.

The parasitic capacitance 87 is inherent to the FED 10 and its configuration. The parasitic capacitance 87 is effectively coupled between the channel of the sampling transistor 85 and ground and performs the functional equivalent of the capacitor forming the holding circuit 90 of FIG. 5. The parasitic capacitance 87 of the display 10 stores each of the sampled voltages from the sampling circuit 85, in response to the control signal 86. The discharge circuit 70 then discharges each stored sampled voltage to produce an output sawtooth signal 72. The sawtooth signal 72 is then input directly to the gates of the transistors 15 to control current to the emitter sets 30.

Figure 7:
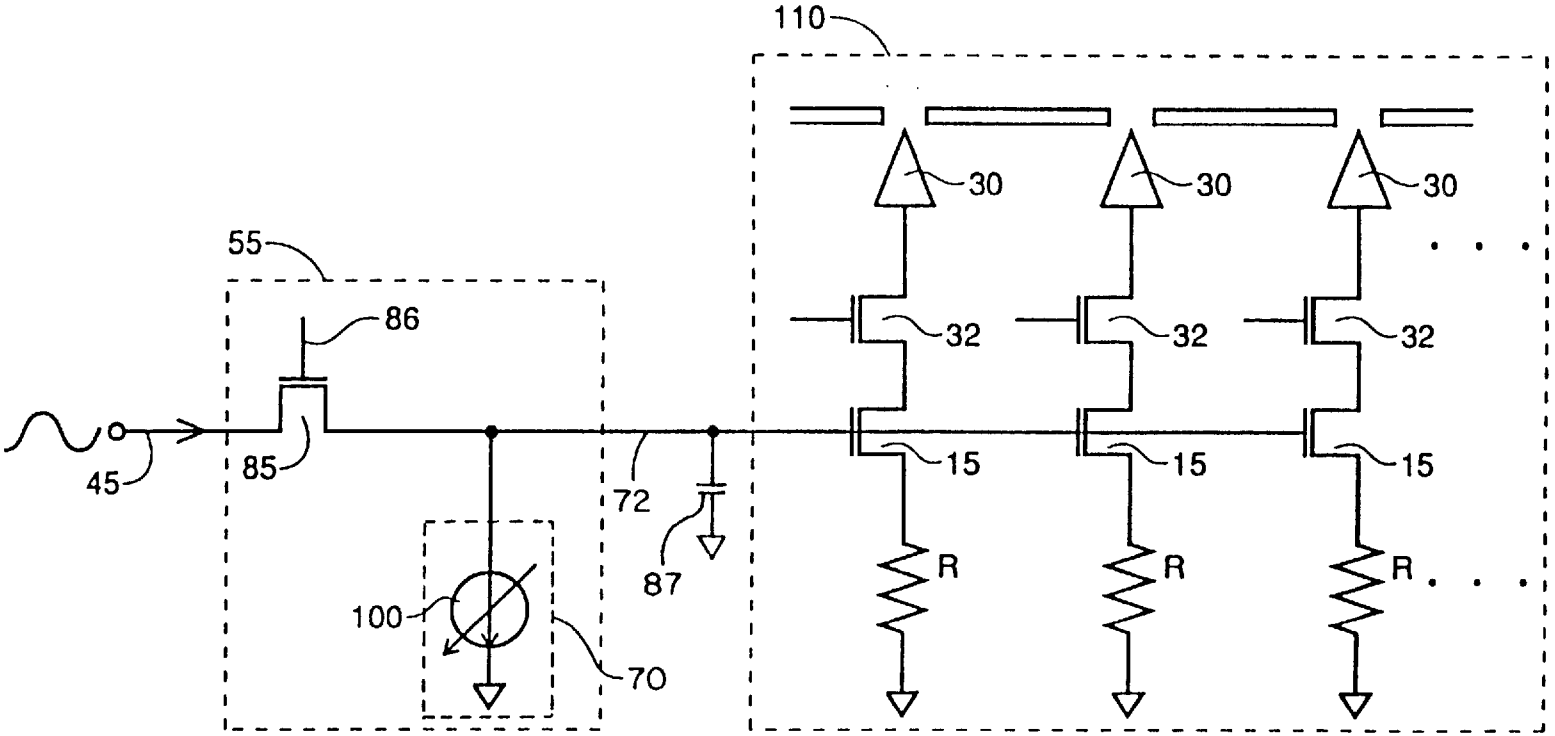
FIG. 7 is a schematic illustrating a third embodiment of the present invention.

In FIG. 7, a third realization of the present invention is illustrated which is identical to the embodiment of FIG. 6, except that the discharge transistor 95 is removed. Elements 45, 85, 86, 87, 100, and 72 are structurally and functionally equivalent to similarly numbered elements discussed with reference to FIG. 6 except that the constant current source 100 continuously discharges the parasitic capacitance 87, because the discharge transistor 95 is eliminated.

Like the above-described embodiment of FIG. 6, the current control circuit 55 of FIG. 7 produces the sawtooth signal 72. The sawtooth signal 72 is then input directly to the gates of the transistors 15 to control current flow to the emitter sets 30.

In FIG. 8, a fourth realization of the present invention is depicted in which the holding circuit 90 is a discrete capacitor and the pixel driver 75 is coupled between the current control circuit 55 and the row 110. Also, the discharge transistor 95 is eliminated. Elements 45, 72, 75, 85, 86, 90, and 100, are structurally and functionally equivalent to similarly numbered elements discussed with reference to FIG. 6.

In a further embodiment of the present invention (not shown), an attenuator controls the amplitude of the output pulse 51 to increase or decrease the amplitude of the output pulse 51 depending upon the application. For example, the attenuator can be controlled by a light sensor to compensate for ambient light surrounding the FED 10. In response to high ambient light readings the attenuator passes the output pulse 51 with no attenuation for maximum light intensity. In response to low ambient light levels, the attenuator reduces the amplitude or duration of the output pulse 51 to reduce the light intensity.

In still another embodiment of the present invention, a contrast control circuit expands or contracts the gray scale range of the FED 10. The contrast control circuit increases control of the ramping of the sawtooth signal 72 to expand or contract the pulse width range. One of skill in the art will recognize a variety of techniques for controlling the ramping of the sawtooth signal 72 and thus the pulse width range.

Figure 10:
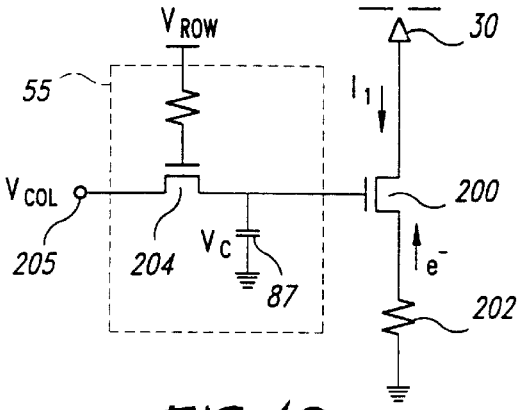
FIG. 10 is a schematic illustrating a fifth embodiment of the invention including a parasitic capacitance storing a line voltage.

FIG. 10 presents an embodiment of the invention in which the circuitry for producing a sawtooth wave is eliminated to simplify the current control circuit 55. To further simplify the current control circuit 55, the parasitic capacitance 87 is used as the only storage element. The current control circuit 55 is controlled by a column voltage $V_{COL}$ and a row voltage $V_{ROW}$ provided by conventional circuitry in response to an input image signal.

In this embodiment, a single NMOS transistor 200 and a limiting resistor 202 are coupled between the emitter set 30 and ground to control current flow between the emitter set 30 and ground. The limiting resistor 202 provides a series resistance to limit the maximum current through the emitter set 30. One skilled in the art will recognize that, although only a single transistor 200 is presented in FIG. 10, additional transistors, such as the enable/disable transistor 32 of FIG. 1 can be added to the current control circuit 55 without departing from the scope of the invention.

The parasitic capacitance 87 couples the gate of the transistor 200 to ground. Additionally, a pass transistor 204 couples the gate to the column voltage $V_{COL}$ from a column line 205. The pass transistor 204 operates as a switch, under control of the row voltage $V_{ROW}$. When the row voltage $V_{ROW}$ is high, the pass transistor 204 is ON and couples the column voltage $V_{COL}$ from the column line 205 to the gate of the transistor 200 and to the parasitic capacitance 87. When the row voltage $V_{ROW}$ is low, the pass transistor 204 is OFF and isolates the gate of the transistor 200 from the column line.

Isolating the gate of the transistor 200 from the column line 205 does not necessarily turn the transistor 200 OFF. Instead, when the gate of the transistor 200 is isolated from the column line 205, the parasitic capacitance 87 retains a stored voltage $V_C$. Once the pass transistor 204 is OFF, the voltage $V_C$ retained by the parasitic capacitance 87 establishes the gate voltage of the transistor 200. Because the transistor 200 and pass transistor 204 are MOS devices, they present extremely high impedances such that the voltage $V_C$ across the parasitic capacitance 87 remains substantially constant after the pass transistor 204 is turned OFF.

Figure 11:
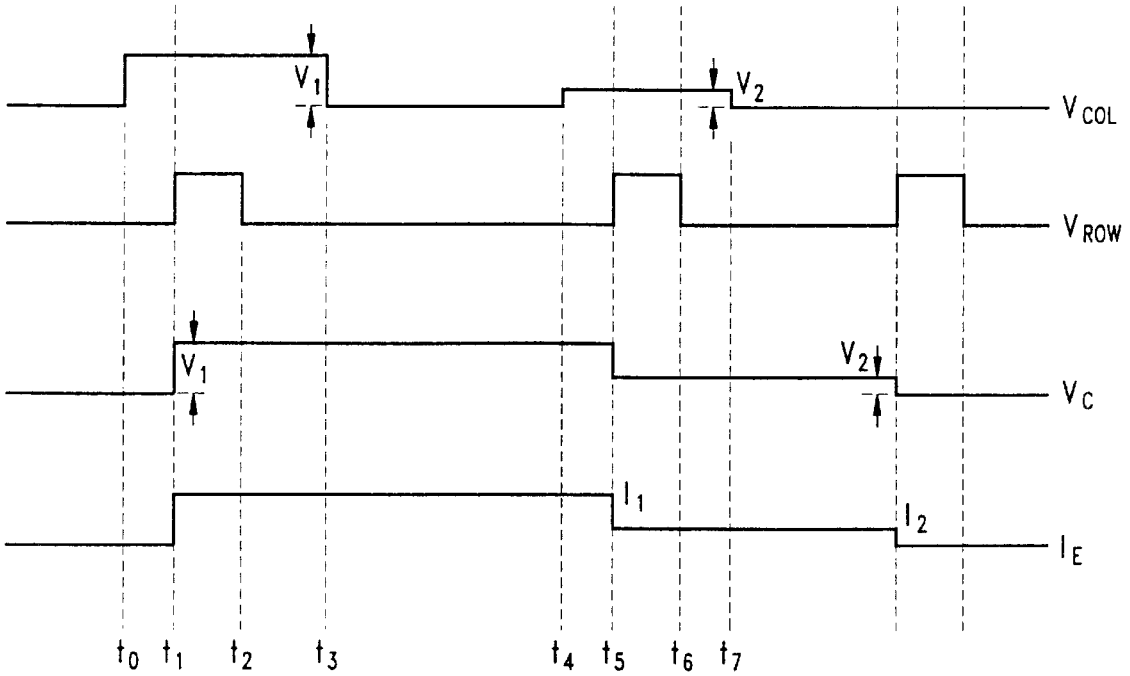
FIG. 11 is a waveform diagram showing signals at various locations in the circuit of FIG. 1O.

Operation of the device of FIG. 10 is best explained with reference to the signal timing diagrams of FIG. 11. As shown in the uppermost diagram of FIG. 11, the column voltage $V_{COL}$ rises to a high voltage $V_1$ at a time $t_0$. At the time $t_0$, the row voltage $V_{ROW}$ is low, such that the pass transistor 204 is OFF. Consequently, the pass transistor 204 blocks the high voltage $V_1$ from affecting operation of the remainder of the circuit.

After the column voltage $V_{COL}$ reaches the high voltage $V_1$, the row voltage $V_{ROW}$ goes briefly high at a time $t_1$. In response to the high row voltage $V_{ROW}$, the pass transistor 204 turns ON, coupling the column voltage $V_{COL}$ to the gate of the transistor 200 and to the parasitic capacitance 87. The capacitor voltage $V_C$ rises quickly in response to the high voltage $V_1$. Because the capacitor voltage $V_C$ is greater than the threshold voltage $V_T$ of the transistor 200, the transistor 200 turns ON, allowing a current $I_E$ to flow from the emitter set 30 to ground. The magnitude $I_1$ of the emitter current $I_E$, and thus the brightness of the pixel, is determined by the capacitor voltage $V_C$ and by the value of the limiting resistor 202.

Once the capacitor voltage $V_C$ is set, the row voltage $V_{ROW}$ goes low, turning OFF the pass transistor 204 and isolating the gate of the transistor 200 from the column voltage $V_{COL}$. Because the parasitic capacitance 87 has stored the voltage $V_1$ from the column line, the transistor 200 remains ON and the current $I_1$ continues to flow from the emitter set 30 to ground.

Shortly thereafter, at time $t_3$, the column voltage $V_{COL}$ returns low. Because the pass transistor 204 is OFF, the change in column voltage $V_{COL}$ does not affect the gate voltage of the transistor 200 and thus does not affect current flowing from the emitter set 30 to ground. It will be understood, that although the column voltage $V_{COL}$ is represented as going low at the time $t_3$, the column voltage may change to some other voltage level to allow activation of other pixels along the same column.

Some time later, the pixel is refreshed, i.e., re-activated by the column voltage $V_{COL}$ to a new illumination level. The refresh time begins at a time $t_4$, when the column voltage $V_{COL}$ rises to a new voltage level $V_2$ corresponding to the new illumination level for the pixel. Once again, because the row voltage $V_{ROW}$ is low, the pass transistor 204 is OFF and the change in column voltage $V_{COL}$ does not affect operation of the remainder of the current control circuit 55. Shortly after the time $t_4$, at time $t_5$, the row voltage $V_{ROW}$ goes high, turning ON the pass transistor 204 and coupling the column voltage $V_{COL}$ to the gate of the transistor 200 and to the parasitic capacitance 87. The changed gate voltage on the transistor 200 changes the current $I_E$ flowing from the emitter set 30 to ground.

As before, the row voltage $V_{ROW}$ returns low shortly after going high, at a time $t_6$, thereby trapping the column voltage $V_{COL}$ with its magnitude $V_2$ on the parasitic capacitance 87. Next, at time $t_7$, the column voltage $V_{COL}$ returns low once again. Because the pass transistor 204 is OFF, the change in column voltage $V_{COL}$ does not affect the current $I_E$ from the emitter set 30 to ground.

As can be seen from the above discussion, the circuit of FIG. 10 controls the current $I_E$ from the emitter set 30 to ground in an analog fashion by controlling the gate voltage of the transistor 200. This differs from the previously described approaches which rely upon pulse width modulation to control the time during which current flows from the emitter set 30 to ground. Also unlike the previously described approaches, the current control circuit 55 of FIG. 10 does not rely upon controlled discharging of current from a capacitor to ground. Instead, the current control circuit 55 of FIG. 10 utilizes the high impedance of the MOS transistors 200, 204 to trap the column voltage $V_{COL}$ on the parasitic capacitance 87 and fix the gate voltage of the transistor 200. The current control circuit 55 does not require an additional capacitor to supplement the inherent parasitic capacitance 87, because the voltage across the parasitic capacitance 87 remains substantially constant rather than being controllably discharged by a discharging circuit. For example, the parasitic capacitance 87 is about 0.2 pf in the preferred embodiment and the leakage current of the transistors 200, 204 less than 1 pA. For a refresh rate of 60 Hz, the time between refreshes of the parasitic capacitance 87 is 0.0166 seconds. Consequently, the capacitance voltage changes less than 0.0833 V between refreshes.

While the particular invention has been described with reference to illustrative embodiments, this description is not meant to be construed in a limiting sense. It is understood that although the present invention has been described in a preferred embodiment, various modifications of the illustrative embodiments, as well as additional embodiments of the invention, will be apparent to persons skilled in the art upon reference to this description without departing from the spirit of the invention, as recited in the claims appended hereto. For example, the current control circuit 55 of FIG. 10, like that of FIG. 5, can drive a plurality of transistors 200 to control multiple emitter sets 30. It is therefore contemplated that the appended claims will cover any such modifications or embodiments as fall within the true scope of the invention.

All of the U.S. Patents cited herein are hereby incorporated by reference as if set forth in their entirety.

We claim:

1. A method of controlling current flow to an emitter set in a field emission display wherein the field emission display includes a current driving circuit coupled between a first reference potential and the emitter set, the current driving circuit having a voltage controlled input terminal and a predetermined capacitance between the input terminal and a second reference potential, the predetermined capacitance consisting solely of a parasitic capacitance, comprising the steps of:

providing an image signal to the display;

charging the parasitic capacitance to a first driving voltage in response to the image signal;

electrically isolating the parasitic capacitance while retaining the first driving voltage across the parasitic capacitance; and passing current from the emitter set to the first reference potential in response to the retained first driving voltage across the parasitic capacitance.

2. The method of claim 1 wherein the step of providing a driving signal comprises producing an analog signal having a voltage level corresponding to a voltage level of the image signal.

3. The method of claim 1, further including the steps of:

charging the parasitic capacitance to a second driving voltage different from the first driving voltage;

retaining the second driving voltage with the parasitic capacitance;

passing current from the emitter set to the first reference potential in response to the retained second driving voltage.

* * * * *